United States Patent [19]

Brown et al.

[11] Patent Number: 4,783,078

[45] Date of Patent: Nov. 8, 1988

[54] WOUND GOLF BALLS

[75] Inventors: Robert A. Brown, Mattapoisett; John Giza, Acushnet, both of Mass.

[73] Assignee: Acushnet Company, New Bedford, Mass.

[21] Appl. No.: 19,878

[22] Filed: Feb. 27, 1987

[51] Int. Cl.[4] ..... A63B 37/06

[52] U.S. Cl. ..... 273/216; 273/226; 273/227

[58] Field of Search ..... 273/222–227, 273/228, 229, 230, 231, 214, 215, 216, 62

[56] References Cited

U.S. PATENT DOCUMENTS 712,611 11/1902 Spear ..... 273/227

2,200,257 5/1940 Bogoslowsky ..... 273/224

*Primary Examiner*—George J. Marlo

*Attorney, Agent, or Firm*—Lucas & Just

[57] ABSTRACT

The present invention relates to golf balls and in particular to an improvement in wound golf balls, especially those which have a liquid center. By using a two-storage winding process, breakage of threads about the center is reduced. The two-stage process uses a first step of winding at low tension followed by a second step of winding at high tension. The low tension winding is done at a tension which is at least 20% less than the tension used in the high tension winding step. The low tension winding step is employed for a period of time between 1½ to 18 seconds.

5 Claims, 2 Drawing Sheets

WOUND GOLF BALLS

The present invention relates to golf balls and in particular to an improvement in wound golf balls.

At the present time there are three basic types of golf balls which are sold. These are the one piece, the two-piece solid and the wound. The one piece is a homogeneous mass of plastic while the two piece is a homogeneous plastic core with a cover thereabout. In a three-piece ball there is a center, which may be liquid or solid, a plurality of windings about the center to form what is called a wound core and a cover about the wound core. The present invention relates to these wound balls.

The center of a wound ball may be of either the liquid type or the solid type. If it is of the liquid type it is generally composed of a thin-walled hollow sphere commonly called an envelop, which is filled with a liquid. The liquid is generally selected according to its specific gravity so that the overall weight of the ball is within the limit of the rules, i.e. no greater than 1.62 ounces. A typical liquid used is corn syrup, adjusted for specific gravity by the addition of an inert filler. A solid center in a wound golf ball is usually a very resilient material such as polybutadiene or natural rubber.

The size of the center in wound balls typically varies from 1 inch to about 1⅛ inch with a typical dimension being 1-1/16 inch. It has recently been found that increasing the size of the center reduces the spin velocity of the ball and correspondingly reduces the trajectory height of the ball. Some golfers find such a reduced trajectory to be desirable.

The threads wound about the center of the ball are usually stretched as tightly as possible without subjecting them to unnecessary incidents of breakage. The reason for this is that the tighter the elastic bands are wound, the more lively the ball. The twofold benefit of this is a relatively high compression for the ball and a relatively high initial velocity.

The threads wound about golf balls are not, of course, perfect. It is known that they frequently contain weak points because of blisters, impurities and other imperfections. Because of this, most manufacturers of wound golf balls do not try to get the ultimate tightness, technically called elongation, out of a thread. Most manufacturers stay at least 3 to 4% below ultimate elongation but, except for specialty products, do not generally use below 85% of ultimate elongation.

There will from time to time be thread breakages even when using a winding tension less than ultimate elongation. If these occur during winding, they are simply an annoyance since the situation can be corrected by restarting the winding of the ball. However, when such breakages occur in the field due to impact of a club face with a ball, they can result in substantially deleterious effects. There can be a substantial loss in velocity of the ball and, in some instances, the ball can end up substantially out-of-round. Even a few instances of such incidents are deleterious to the reputation of a manufacturer.

The applicants have found that the major instances of such problems occur when the thread closest to the center breaks upon impact. The threads nearest the cover are not subject to unraveling if they break because the cover material inherently flows into the interstices of the threads during the cover molding process. With the threads between the cover and the area around the center, breakage of the thread is not deleterious (unless it is severe) because the threads above and below the broken threads tend to "lock" the ends of the broken thread in place. However, in the area abutting the center of the ball, a breaking of the thread can cause substantial problems. The worst case which has been found is where a thread abutting the center breaks and, as it contracts due to relaxation of the tension on it, it actually acts like a knife and cuts through the thin wall of the hollow sphere of the liquid center. This destroys the structural integrity of the ball and makes it unplayable. Should this happen to occur when a person has just made a shot, it can result in substantial deviation of the ball from its line of flight as it leaves the club face and can also result in a very short shot. Both of these are highly undesirable.

While the situation is not so severe with a solid center, there is still a problem. Because the solid center is actually a resilient material and relatively soft as compared to the hardness of the highly stretched windings a broken thread adjacent the center can contract and cause a loss of compression and initial velocity.

The applicants have found not only the cause of the problem but have also found solution to the problem. The solution as found by the applicants is to reduce substantially the tension applied to the thread during the initial stages of winding the thread about the center. Because of the reduced tension, irregularities in the thread are less likely to cause a break in the thread. Furthermore, if a break does occur, the likelihood of contraction and the rate of contraction are substantially reduced for two reasons. In the first place, there is less elongation and therefore less of an ability to contract. In the second place, the reduced tension applied to the thread makes a locking of the thread against the center by adjacent rows of threads more likely. Even if the thread does break and contract, it is substantially less likely to cut the wall of the envelop of a liquid center since the contraction is at a slower rate and over a shorter distance as compared to high tensioned thread.

In addition to the foregoing benefits, it has also been found that other advantages are achieved by the reduced tension of the initial winding. Despite the reduced tension, the rate of application of the thread remains the same. The thread as applied is thus thicker than highly tensioned thread. This redistributes the weight in the golf ball slightly and reduces the spin rate of the ball, all other factors being equal. Furthermore, because the thread is thicker, the total amount of thread which must be applied to an individual ball is reduced. While the saving in thread per ball is very small, the saving in thread when multiplied by the millions of dozens of golf balls produced per year by the major manufacturers leads to a substantial cost saving.

Another advantage of the reduced initial tension of winding is an overall reduction in breakage of the thread during the winding portion of the manufacturing process. When a thread goes from no elongation to a very high elongation over a short period of time, it is much more likely to break than when there is an intermediate tension at which the thread is kept for a portion of the winding. From a study of actual commercial production, applicants have found that a disproportionately high percentage of thread breaks occur during the initial start-up of winding. Applicants have further found that winding a golf ball according to the present invention substantially reduces this incidence of breakage at the initial stage of wind-up.

These and other aspects of the following invention may be more fully understood with reference to the drawings wherein.

Figure 1:
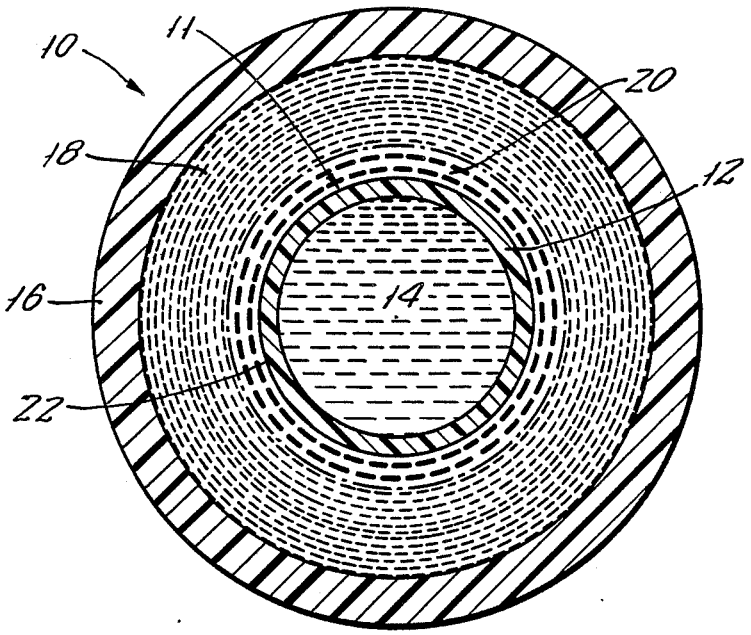
FIG. 1 shows a golf ball according to the present invention with a liquid center.

Referring first to FIG. 1, there is shown a golf ball 10 having a liquid center 11. The liquid center comprises a rubber envelop 12 with a liquid 14 therein. A cover 16 is about the exterior of the ball. The cover 16 is of conventional construction such as balata, gutta percha, ionomer, polyurethane or a combination of the foregoing. Between the cover 16 and the center envelop 12 is elastic thread 18 and 20. In accordance with the present invention, the thread 20 closest to the envelop 12 is wound at lower tension than the balance of the thread 18. There is a line 22 in the drawing which demarcates the barrier between the low tension thread and the high tension thread. However, line 22 is imaginary, not real. In actual practice there is no line since the thread 18 is a continuation of the thread 20; in other words, all of the thread is made from many windings of a single, continuous strand of thread.

Figure 2:
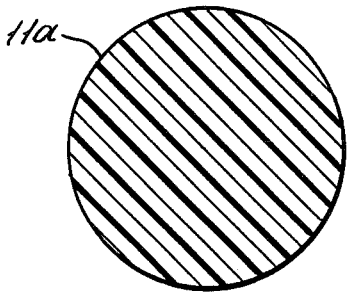
FIG. 2 shows a solid center, which may be substituted for the liquid center of FIG. 1.

Referring to FIG. 2, there is shown a solid center 11*a* which can be used in place of liquid center 11. While center 11*a* is conventionally referred to as "solid", it is actually a resilient material such as natural rubber or polybutadiene.

Referring back to FIG. 1, the amount of thread 20 which abuts the center 11 is important. If there is too little of the low tension thread 20, the advantages of the present invention are not obtained, e.g. higher strength for the ball. If the amount of low tension thread 20 is too high, the resulting ball has excellent strength but also has too low a compression and too low an initial velocity to be a competitive golf ball.

Figure 3:
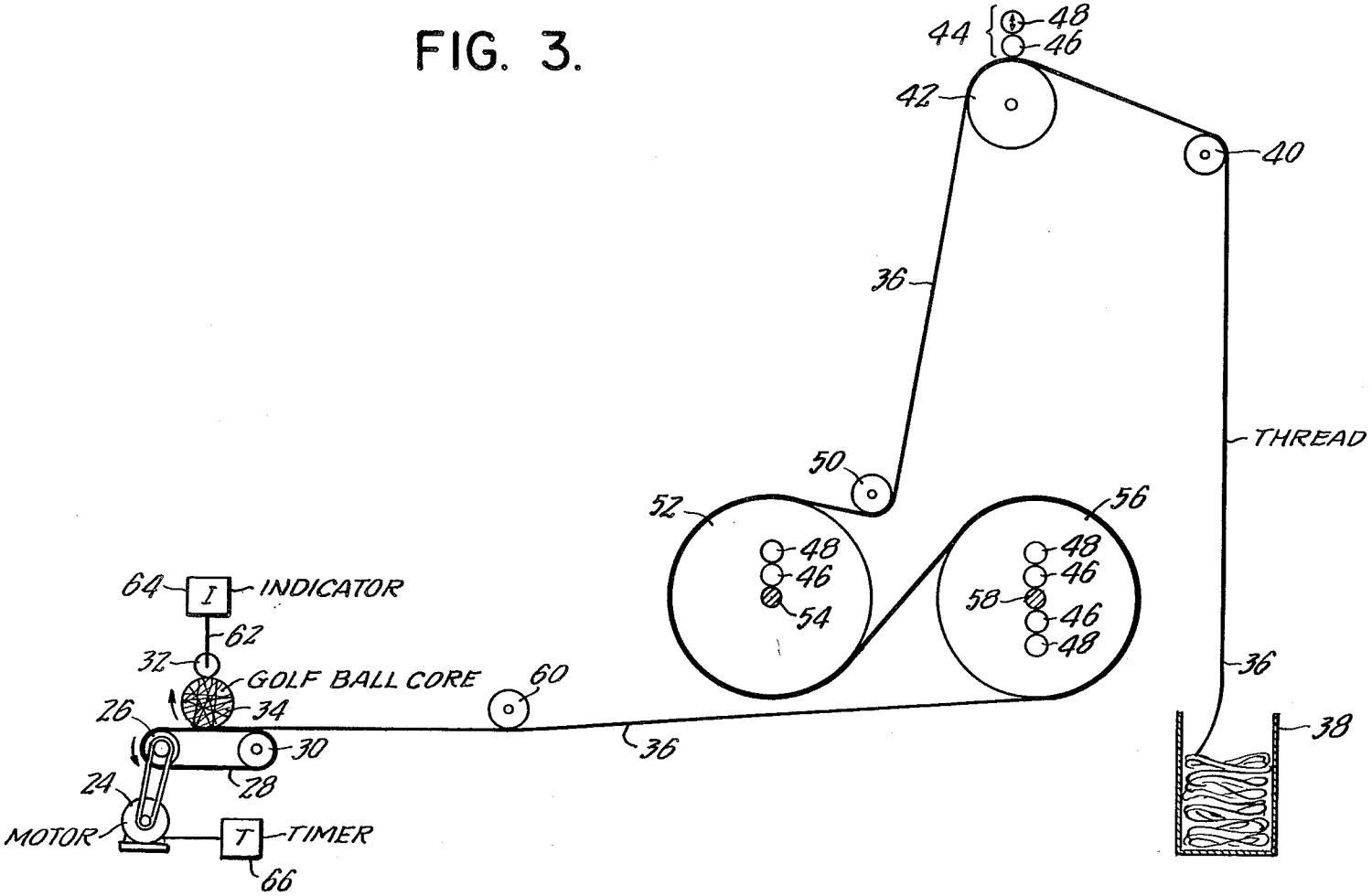
FIG. 3 shows a typical golf ball winding apparatus.

Turning now to FIG. 3, there is shown a golf ball winding apparatus. The basic apparatus is well-known in the industry. A motor 24 drives a wheel 26 about which there is a rubber belt 28, the belt travelling around wheel 30 before returning to drive wheel 26. A wheel 32 bears on a golf ball center 34 in contact with the belt 28. As the golf ball turns, it draws thread 36 through the tensioning system from the supply box 38 of thread 36. From the supply box 38, the thread 36 first passes over an idler roll 40 and then to a tension wheel 42. The tension wheel 42 preferably has a groove (not shown) in which the thread travels. The groove is of less depth than the thickness of the thread so that tension apparatus 44 can apply nip-like pressure on the thread. Tension apparatus 44 comprises a rubber tension wheel 46 and a metal tension wheel 48. Metal wheel 48 is biased for up and down movement. When it is up, no tension is applied to the thread. During normal winding operations, metal wheel 48 is in the down position and causes rubber wheel 46 to engage the thread. The rubber wheel 46 in combination with wheel 42 essentially acts like a nip roll with respect to the thread 36.

From this initial tension apparatus 44, the thread 36 travels around idler roll 50 to low tension wheel 52. Low tension wheel 52 has tension wheels 46 and 48 which are the same as in tensioning apparatus 44. In this case, however, the tension wheels 46 and 48 bear against axle 54 of low tension wheel 52. It will be appreciated that the pressure which is applied to axle 54 by tension wheels 46 and 48 will directly affect the degree of stretch of the elastic thread 36 as it is wound onto the golf ball core 34. While tension will be increased between tension wheel 52 and golf ball core 34, the rate of feed of thread 36 will be the same since that is solely dependent on the rate of feed through tension apparatus 42.

After low tension wheel 52, the thread passes over high tension wheel 56. In order to be able to exert sufficient force on the axle 58 of high tension wheel 56, there are two pairs of tension rollers 48 and 46. After the thread leaves high tension wheel 56, it goes through idler roll 60 to the golf ball core. Golf ball center 34 is shown with some windings of thread thereabout. As the size of the golf ball core increases due to the addition of more thread, wheel 32 rises and rod 62 attached thereto also rises. Rod 62 can suitably be the core of a transducer which can serve as an indicator 64 of the then diameter of the golf ball core. A timer 66 can be used in conjunction with motor 24.

In accordance with the present invention, low tension wheel 52 is always engaged while motor 24 is in operation. High tension wheel 56 is not operated during the initial period of winding so that only low tension is being applied to the thread initially. At a preselected point, tension is applied to high tension wheel 56. The instance of engagement of high tension wheel 56 can be determined by timer 66 or by indicator 64 or, preferably, by both. Where a timer is used, the time after thread starts winding about the golf ball core 34 is monitored by the time when the motor starts. At a preselected time, the timer generates a signal which puts high tension wheel 56 into operation. Alternatively, or additionally, indicator 64 can be used. Indicator 64 senses the diameter of the golf ball core. As the threads wind about the center 34, the size of the golf ball core increases. When it has reached a preselected diameter for the amount of low tension thread, the indicator generates a signal to put the high tension wheel 56 into operation. It has been found that best results are achieved when both the timer and indicator are used. This is an additional check in determining any malfunction of the winding apparatus. The timer and/or indicator can also be used to indicate when a golf ball core is fully wound.

The various dimensions of golf balls according to the present invention will vary from manufacturer to manufacturer. While some manufacturers make golf balls of 1.75 inch or even greater, most manufacturers use a minimum diameter of 1.68 inches (the USGA minimum) and a maximum diameter of 1.7 inches. The exception to this is British size balls which are generally 1.62–1.64 inch since the Royal and Ancient rules have a minimum diameter of 1.62 inches.

Core sizes can range all over the lot, from $\frac{3}{4}$ inch to $1\frac{3}{8}$ inch (see J. S. Martin, The Curious History of the Golf Ball, Horizon, 1968). However, it is preferably from 1 inch to 1-3/16 inch. Similarly, the thickness of the envelop for the center of the ball can range widely, e.g. from 0.02 inch to 0.25 inch. It is preferred to be 0.075 to 0.15 inch.

The thickness of the cover is also widely variable. Covers can be as thin as 0.02 inch or as much as 0.25 inch. Covers of 0.03 inch to 0.075 inch are preferred.

Thread sizes are measured in the non-tensioned state and threads will generally have a width of 0.02 inch to 0.2 inch and a thickness of 0.01 inch to 0.1 inch. It is preferred that the thread have a width of 0.05 inch to 0.15 inch and a thickness of 0.02 inch to 0.05 inch.

The amount of thread is, of course, a function of the size of the center, the size of the ball and the thickness of the cover. Obviously the thread must occupy the volume between the outside of the center and the inside of the cover.

The amount of low tension thread 20 which is put on the ball is somewhat dependent on the compression desired for the ball, at least with threads that are currently available. It is preferred that at least 3% of the thread applied be applied at a low tension. In order to make a golf ball which will have acceptable playing characteristics, it is preferred that no more than 75% of the thread be applied at low tension. While some golf balls today are sold with compressions of 50–60, most of the "top grade" golf balls sold today have a nominal compression of 90 or 100. For obtaining this type of golf ball, it is preferred to limit the amount of low tension thread to about 5–20% of the total amount of thread. The lower limit generally applies to golf balls of large center diameter where a high compression is desired, e.g. a 1⅛ inch center with a 100 compression. The higher value applies where the center is smaller and a lower compression is acceptable, e.g. a 1 inch center with 80 compression.

As used in this application, low tension thread means thread which is applied at a tension at least 20% below the tension at which the high tension thread is applied. In the golf ball industry, tensions are usually expressed in grams. The measurement is related to ultimate elongation (1000% elongation) of the thread. For example, if a length of thread stretches by 1000% under a load of 1000 grams wherein the load has been applied incrementally up to 1000 grams, the thread would be said to have an ultimate elongation at 1000 grams. For a thread having a 1000 gram ultimate elongation, normal industry practice would be to apply the thread at a high tension, e.g., 850–950 grams depending on the compression of the ball which was desired. In accordance with the present invention, if the high tension was applied at 950 grams, the low tension would be applied at no greater than about 760 grams. Similarly, if the high tension winding was at 850 grams, the low tension winding would be at no greater than about 680. While 20% is the minimum reduction for the low tension thread as compared to the high tension thread, it is preferred that the low tension thread be applied at a tension of at least 35% below that of the high tension thread. Best results have been achieved when the low tension thread is applied at a rate of more than 50% below that of the high tension thread.

There is, of course, an interrelationship between the tension at which the low tension thread is applied and the amount of low tension thread applied. The higher the tension of the low tension thread, the more of it that can be applied without adversely affecting compression. Concomitantly, the lower the tension of the low tension thread, the less the low tension thread should be applied, especially where high compressions are desired and large centers are employed.

In the following examples, there are given illustrative tests of the making of golf balls according to the present invention. For the sake of uniformity, the following were held constant in all of the tests:

1. the centers were liquid filled and had a diameter of 1.125 inch;
2. the thread had a cross-sectional dimension of 0.022"×1/16", a Schwartz value of 185–208 and an ultimate elongation of 1100 grams;
3. the high tension employed was 1060 grams and the low tension was 400 grams;
4. the cover was of balata;
5. the finished diameter of the wound core was 1.61 inch; and
6. the finished diameter of the molded ball was 1.68 inch.

That which is the variable in this series of tests is the amount of low tension thread applied. In the table below, this is expressed both in terms of seconds of delay and in terms of the diameter of the core at the end of the low tension winding. The table is as follows:

TABLE

| | CORE | | MOLDED BALL | | |
|---|---|---|---|---|---|
| Ball | Delay Before High Tension | Diameter After Low Tension Winding | Compression Average PGA | Average Rupture (lbs) | Average Range (lbs) |
| Control | 0 | 1.125 | 90.7 | 4277 | 2500–5250 |
| 1 | 1½ | 1.175 | 87.6 | 4700 | 4200–5300 |
| 2 | 4 | 1.225 | 89.0 | 5960 | 4500–6900 |
| 3 | 6 | 1.260 | 87.0 | 6680 | 6200–7100 |
| 4 | 8 | 1.300 | 87.0 | 6670 | 6000–7400 |
| 5 | 10 | 1.340 | 86.3 | 7100 | 6300–7500 |
| 6 | 12 | 1.370 | 87.0 | 7080 | 6000–7900 |
| 7 | 14 | 1.395 | 87.0 | 7270 | 5800–8400 |
| 8 | 16 | 1.420 | 85.6 | 6680 | 5900–7500 |
| 9 | 18 | 1.440 | 85.5 | 6400 | 5800–6700 |

Referring to the above table, the most meaningful information is in the column headed rupture range. Rupture in the table indicates the pounds of force applied to the ball which caused the ball to rupture. As described earlier, rupture of the center occurs when the thread adjacent the center breaks and cuts through the thin envelop of the liquid center. It is known that substantial thread breaking takes place before actual rupture, but it is easiest to express comparisons in terms of rupture since the number of thread breaks are exceedingly difficult to determine.

Measurements of actual golfers have found that they impact a golf ball with a force approaching the 3,000 pound level in the rupture test. Since some of the golf balls in the control rupture at levels as low as 2,500 pounds, a full hit by a strong golfer can result in rupture of such a ball. With respect to the rupture range of the control, it is pointed out that while the range was 2500–5250, most of the balls fell within the range 3350–5250. Notwithstanding this, there were some balls at the low rupture level. Furthermore, even at 3350 pounds, there is highly likely to be thread breakage even though the center has not yet ruptured.

It will be understood that it is intended to cover all changes and modifications of the preferred embodiments of the present invention herein chosen for the purpose of illustration which do not constitute a departure from the spirit and scope of the invention.

What is claimed is:

1. In a golf ball comprising a center, a cover and elastic thread wherein the elastic thread is wound around the center and positioned between the center and the cover, the improvement comprising said wound thread having the structural characteristics resulting from a two-step winding process for winding the elastic thread about the center consisting essentially of a first winding step wherein the elastic thread is wound at a constant low tension about the center for a period of time between $1\frac{1}{2}$ to 18 seconds; and a second subsequent winding step wherein the elastic thread is wound at a constant high tension, the constant low tension being at least 20% below the tension of the constant high tension.

2. The golf ball of claim 1 wherein the constant low tension is at least 35% below the tension of the constant high tension.

3. The golf ball of claim 1 wherein the constant low tension is more than 50% below the tension of the constant high tension.

4. The golf ball of claim 1 wherein the elastic thread has an ultimate elongation of 1000 grams and the constant high tension is between 850 grams to 950 grams.

5. The golf ball of claim 1 wherein the elastic thread has an ultimate elongation of 1000 grams and the constant low tension is between 760 grams to 680 grams.

* * * * *